US007115043B2

(12) United States Patent
Leadbetter et al.

(10) Patent No.: US 7,115,043 B2
(45) Date of Patent: Oct. 3, 2006

(54) GOLF SWING TRAINING DEVICE AND METHOD

(75) Inventors: David Leadbetter, Orlando, FL (US); F. Blaik Shew, Orlando, FL (US)

(73) Assignee: Swing King, LLC, Champions Gate, FL (US)

( * ) Notice: Subject to any disclaimer, the term of this patent is extended or adjusted under 35 U.S.C. 154(b) by 89 days.

(21) Appl. No.: 10/850,342

(22) Filed: May 20, 2004

(65) Prior Publication Data

US 2005/0009618 A1 Jan. 13, 2005

Related U.S. Application Data

(60) Provisional application No. 60/476,256, filed on Jun. 5, 2003, provisional application No. 60/472,711, filed on May 22, 2003.

(51) Int. Cl.
*A63B 69/36* (2006.01)

(52) U.S. Cl. ..... 473/257; 473/219; 473/234

(58) Field of Classification Search ..... 473/203–206, 473/220–226, 256, 257, 219, 231–234, 266; 446/266, 486; 33/508
See application file for complete search history.

(56) References Cited

U.S. PATENT DOCUMENTS

| | | | | |
|---|---|---|---|---|
| 715,225 | A | | 12/1902 | Whitner |
| 1,075,054 | A | | 10/1913 | Morley |
| 1,638,454 | A | | 8/1927 | Papin |
| 1,676,270 | A | * | 7/1928 | Mattison ..... 473/234 |
| 1,690,312 | A | | 11/1928 | Rosan |
| 2,088,008 | A | | 7/1937 | Link |
| 2,135,648 | A | | 11/1938 | Stumpf |
| D125,602 | S | | 3/1941 | Wheeler et al. |
| 2,388,463 | A | | 11/1945 | Benecke |
| 2,396,408 | A | | 3/1946 | Benecke |
| 2,628,100 | A | | 2/1953 | Beebe |
| 2,782,422 | A | | 2/1957 | Bencriscutto |
| 2,950,115 | A | | 8/1960 | Hurdzan |
| 2,962,288 | A | | 11/1960 | Lowden |
| 3,111,322 | A | | 11/1963 | English |
| 3,227,455 | A | * | 1/1966 | Hulsman ..... 473/206 |
| 3,256,023 | A | | 6/1966 | Frazelle |
| 3,428,325 | A | | 2/1969 | Atkinson |
| 3,498,616 | A | * | 3/1970 | Hurst ..... 473/234 |
| 3,725,957 | A | | 4/1973 | Shotmeyer |
| 3,875,591 | A | | 4/1975 | Cantales |
| 4,025,077 | A | | 5/1977 | Thompson |
| 4,027,886 | A | | 6/1977 | Katsube |
| 4,295,832 | A | * | 10/1981 | Karell ..... 434/468 |
| 4,511,147 | A | | 4/1985 | Olsen |
| 4,569,525 | A | | 2/1986 | Folger |
| 4,665,565 | A | | 5/1987 | Odom |
| 4,809,975 | A | | 3/1989 | Lee |
| 4,836,544 | A | | 6/1989 | Lai |
| 4,848,746 | A | | 7/1989 | Klink |

(Continued)

*Primary Examiner*—Nini F. Legesse
(74) *Attorney, Agent, or Firm*—Allen, Dyer, Doppelt, Milbrath & Gilchrist, P.A.

(57) ABSTRACT

A golf swing training aid includes a shaft having two sliding elements which are moved from initially coupled positions on the shaft to impact positions during the backswing and downswing make distinctive sounds at impact positions to aid in setting the club and hinging the shaft when executing the backswing and lagging of the club during the downswing. Grip protrusions are biased against webs of the fingers for enhance power generated during the swing.

51 Claims, 12 Drawing Sheets

U.S. PATENT DOCUMENTS 4,981,297 A 1/1991 Foster
5,042,811 A 8/1991 D'Amico
5,082,279 A * 1/1992 Hull et al. ..... 473/242
D326,493 S 5/1992 Perry
5,133,551 A 7/1992 Handy et al.
5,143,375 A 9/1992 Wilkins
5,163,685 A 11/1992 Rhodes
5,188,365 A 2/1993 Picard
5,228,695 A 7/1993 Meyer
5,284,464 A 2/1994 Lee, III et al.
5,299,802 A 4/1994 Bouchet-Lassale
5,310,188 A 5/1994 Hernberg
5,332,211 A 7/1994 Rife et al.
5,366,218 A 11/1994 Gong
5,381,614 A 1/1995 Goldstein
5,398,930 A 3/1995 Gibson
5,403,008 A 4/1995 Mainiero
5,415,406 A 5/1995 Reichenbach et al.
D365,131 S 12/1995 Edwards et al.
5,487,546 A 1/1996 Yasuda
5,524,892 A 6/1996 Karp
5,527,039 A 6/1996 Levesque
5,542,126 A 8/1996 Harvanek
5,588,651 A 12/1996 Frost
5,588,653 A 12/1996 Robinson
D378,467 S 3/1997 Leadbetter
5,658,205 A 8/1997 Bartscherer
5,665,007 A 9/1997 Tatum
5,672,117 A 9/1997 Dar
5,704,065 A 1/1998 Feuerhake
5,711,718 A 1/1998 Mueller
5,729,864 A 3/1998 Lie et al.
D395,477 S 6/1998 Vela
5,762,563 A 6/1998 Holzhausen
5,769,734 A 6/1998 Qualey, Sr.
5,776,006 A 7/1998 Gruber
5,851,156 A 12/1998 Schwark, Jr.
5,893,803 A 4/1999 Leadbetter et al.
5,897,440 A 4/1999 Bae et al.
D416,597 S 11/1999 Grove et al.
5,984,795 A 11/1999 Stafford
6,001,025 A 12/1999 Blackmon
6,110,054 A 8/2000 Rodarte
6,132,322 A 10/2000 Bonham
6,238,299 B1 5/2001 Barnette
6,270,430 B1 8/2001 Nicoloff
6,293,875 B1 9/2001 Sanford
D449,360 S 10/2001 Kallassy
D455,843 S 4/2002 Albany et al.
6,363,535 B1 4/2002 Landis
6,440,005 B1 8/2002 Hubenig
6,461,163 B1 10/2002 Gallagher et al.
6,464,597 B1 10/2002 Hardesty
6,475,098 B1 11/2002 Nemeckay
6,500,074 B1 12/2002 Thacker
6,503,149 B1 1/2003 Jelinek
6,599,200 B1 7/2003 Kallassy
6,955,610 B1 * 10/2005 Czaja et al. ..... 473/256
2001/0027136 A1 10/2001 Chris
2002/0072041 A1 6/2002 Gallagher et al.
2002/0094879 A1 7/2002 Dawson
2002/0132678 A1 9/2002 Matzie
2002/0151373 A1 10/2002 Beauregard
2002/0160846 A1 10/2002 Spitzer
2003/0144070 A1 7/2003 Kallassy
2003/0207717 A1 11/2003 Ulrich
2003/0207719 A1 11/2003 Hughes
2003/0211900 A1 11/2003 Novak et al.
2003/0224867 A1 12/2003 Ota
2004/0009826 A1 1/2004 Aisenberg
2004/0023726 A1 2/2004 Ritson et al.
2004/0036194 A1 2/2004 Chadwick et al.
2004/0043828 A1 3/2004 Goldfader

* cited by examiner

GOLF SWING TRAINING DEVICE AND METHOD

CROSS REFERENCE TO RELATED APPLICATIONS

This application claims priority to the Provisional Applications having Ser. No. 60/472,711 and filing date May 22, 2003 for "Golf Grip Training Device and Method" and Ser. No. 60/476,256 and filing date Jun. 5, 2003 for "Golf Swing Training Device and Method," the disclosures of which are herein incorporated by reference in their entirety, and commonly owned.

FIELD OF THE INVENTION

The invention generally relates to golf swing training, and more particularly to training synchronized golf swings through a desired gripping and positioning of a golf club.

BACKGROUND

Good golf begins with a good grip. As described in "The Golf Swing" The Stephen Green Press, 1990; David Leadbetter's Faults and Fixes" Harper Collins Press, 1993; and "Positive Practice" Harper Collins Publishers, 1997, a good golf grip may not lead necessarily to a good swing, but a bad grip is much more likely to cause a bad golf swing. As is well accepted by those of ordinary skill in the art of the golf game, a good solid hold on the club is a first key step towards a correct positioning of the club head throughout the golf swing. Generally, a poor gripping of the club will place too much emphasis on the hands, and will lead to an over-controlling of the club and movement of the club head out of the preferred position for contacting the golf ball. In an athletic swing, the role of the hands is reduced as much as possible.

Many golfers position the golf club or grip in their hands in such a manner that makes it difficult to generate an optimum energy necessary to hit a golf ball their maximum distance. It is desirable that the golfer properly fit the top hand onto the grip. The top hand is the left hand for a right-handed swing, and typically the hand that wears a golf glove for improving the grip. The top hand represents an essential coupling of the golfer to the club. Unfortunately, what may look correct may actually conceal a poor grip. By way of example, it is desirable that the club be held primarily in the fingers of the bottom hand (the right hand for the right handed swing), and that the shaft of the club be diagonally positioned from the base of the little finger through the joints of the second and third fingers and on to the middle of the index finger. When the bottom hand is closed, the top hand thumb should be covered, fitting snugly beneath the fleshy pad at the base of the bottom hand thumb. Various grips have been developed in an effort to train a golfer to achieve a desirable gripping of the golf club and place the hands for a "proper" swinging of the club, such as described in U.S. Pat. No. 5,299,802 to Bouchet-Lassale and U.S. Pat. No. 5,984,795 to Stafford.

As those of skill in the art are well aware, details abound with respect to instructions for the "perfect swing." Further, the art is filled with devices and gimmicks for improving the golf swing to save but a few strokes during a round of golf. However, there remains a need to provide the feel for the proper fitting of the hands to the grip of the golf club, without attempting to clutter the mind with the intricate details of each anatomical element and its relation to the club.

There is further a need to aid the golfer in achieving a smooth flowing motion in the golf swing. By way of example, weighted golf clubs and training shafts have been used to improve the tempo and mechanics of the golf swing, as illustrated by way of example with reference to U.S. Pat. No. 2,388,463 to Benecke and U.S. Pat. No. 6,475,098 to Nemeckay for gold swing training devices. Sliding weights have also been used to aid in the timing of a "release' of the golf, such as the golf club attachment of U.S. Pat. No. 2,950,115 to Hurdzan and U.S. Pat. No. 4,027,886 to Katsube for improving the timing in a golf swing. Those of skill in the art understand that there is a distinction between hitting the ball and swinging through the ball requiring a synchronized movement of the golf club during the swing. The present invention provides a training device and method for achieving a desirable swing.

SUMMARY

The golf swing teaching device and method of the present invention provide, by way of example, a desirable method for "setting" the club and "hinging" the shaft when executing the backswing, an indication of a preferred "lagging" of the club during the forward swing, a correct method for providing preferred angle between shaft and arm, and may teach a desired release of the club head through the hitting area.

One embodiment of the present invention may include a grip carried on a tapered golf shaft with a fixed stop at the opposite end of the shaft from the grip. Two sliding elements are carried on the shaft. A friction barrier is carried on the shaft at a spaced relation to the fixed stop. The two sliding elements on the shaft make distinctive sounds during the swinging of the device in a training process. The two sliding elements may be slidably attached to the shaft at distinct tension levels to allow golfers with various skill levels and ages to develop their swing mechanics. The present invention further provides for a preferred gripping of the golf club. Embodiments of the present invention, as herein described by way of example, allow the golfer to hold the club in a position to cause the clubface to contact the golf ball during the swing for achieving the optimum energy transfer to the ball from the club head and provide a desirable golf ball trajectory.

One embodiment of the invention may include a golf swing training device comprising a grip having a plurality of protrusions outwardly extending therefrom and arranged for receiving multiple finger webs in guiding a hand of the user for gripping the shaft proximal end. Another embodiment may include a shaft defined by a proximal end portion, a distal end portion, and an intermediate portion, a first stop carried within the intermediate portion of the shaft, a second stop fixedly attached to the distal end portion of the shaft, a first element slidably carried by the shaft for movement from the proximal end portion of the shaft toward the first stop, wherein the first sliding element accelerates to the first stop for making contact therewith and creating a first sound thereby, and a second element slidably carried by the shaft for sliding movement from the intermediate portion toward the second stop, wherein the second element accelerates to the second stop for making contact therewith and creating a second sound thereby.

A method aspect of the invention includes a swing training method comprising holding a shaft by a user from a proximal end for a swinging thereof. The shaft includes a first sliding element releasably coupled to a first position on the shaft and a second sliding element releasably coupled to a second position on the shaft. The method may include swinging the shaft in a backswing movement away from the object for generating a first centrifugal force to release the first sliding element from the first position, wherein the first sliding element travels along the shaft to a first stop, making a first distinctive sound upon contacting the first stop, transitioning swinging the shaft from the backswing movement to a downswing movement, and swinging the shaft in a downswing movement toward the object for generating a second centrifugal force to release the second sliding element from the second position, wherein the second sliding element travels along the shaft to a second stop, making a second distinctive sound upon contacting the second stop.

BRIEF DESCRIPTION OF DRAWINGS

For a fuller understanding of the invention, reference is made to the following detailed description, taken in connection with the accompanying drawings illustrating various embodiments of the present invention, in which.

DETAILED DESCRIPTION OF EMBODIMENTS

The present invention will now be described more fully with reference to the accompanying drawings in which alternate embodiments of the invention are shown and described. It is to be understood that the invention may be embodied in many different forms and should not be construed as limited to the illustrated embodiments set forth herein. Rather, these embodiments are provided so that this disclosure may be thorough and complete, and will convey the scope of the invention to those skilled in the art.

Figure 1:
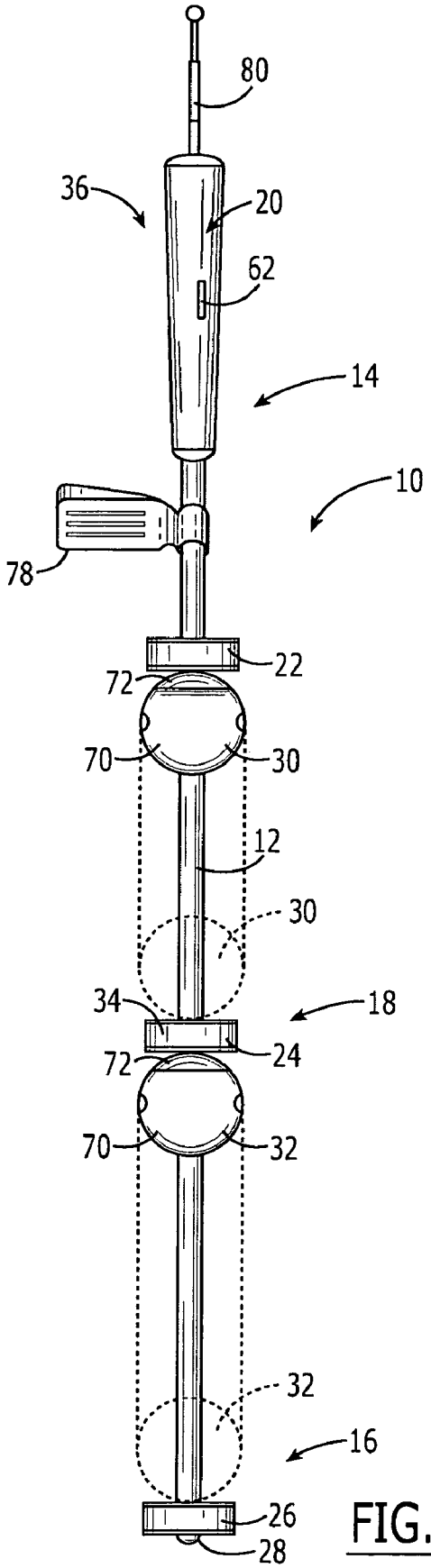
FIG. 1 is a plan view of one embodiment of a swing training device is keeping with the teachings of the present invention.

With reference initially to FIG. 1, one embodiment of the includes a golf swing training device 10 having an elongate shaft 12 with a proximal end portion 14 for holding the device by a user, an opposing distal end portion 16, and an intermediate portion 18 therebetween. A grip 20 may be affixed at the proximal end portion 14. A first coupling 22 is affixed to the shaft 12 generally within the proximal end portion 14, but may be located as desired along the shaft length. A second coupling 24 is affixed the shaft 12 within the intermediate portion 18, by way of example for the embodiment herein described. A stop 26 is attached to the shaft 12 at the distal end portion 16, herein illustrated at an extreme end 28 of the shaft. The shaft 12 carries a first sliding element 30 for movement between the first coupling 22 and the second coupling 24, and a second sliding element 32 for movement between the second coupling 24 and the stop 26. The sliding elements 30, 32 have sufficient weight for responding to centrifugal forces during the swinging of the shaft 12 by a user when holding the grip 20 in simulating a golf swing.

With continued reference to FIG. 1, the first sliding element 30 is initially coupled to the first coupling 22 and the second sliding element 32 is coupled to the second coupling 24 prior to a swinging of the shaft in a training exercise. As will be further detailed later in this section, the first sliding element 30 is released from the first coupling 22 by a first centrifugal force generated by the swinging of the shaft 12 during a first swinging motion (known in golfing as a backswing). The first sliding element 30 accelerates toward the second coupling 24 and makes a first distinctive sound upon contact with a back surface 34 of the second coupling. The second sliding element 32, initially coupled to the second coupling 24, remains coupled during the backswing and is released during a second swinging motion (known in golfing as a downswing) by a second centrifugal force generated during the second swinging motion of the shaft 12. The second sliding element 32 accelerates toward the stop 26 and makes a second distinctive sound when contacting the stop. For the embodiment of the device 10, herein described with reference to FIG. 1, the shaft 12 comprises a circular cross section, and has a constant cross section along lengths of the shaft having the sliding element movements.

Figure 2:
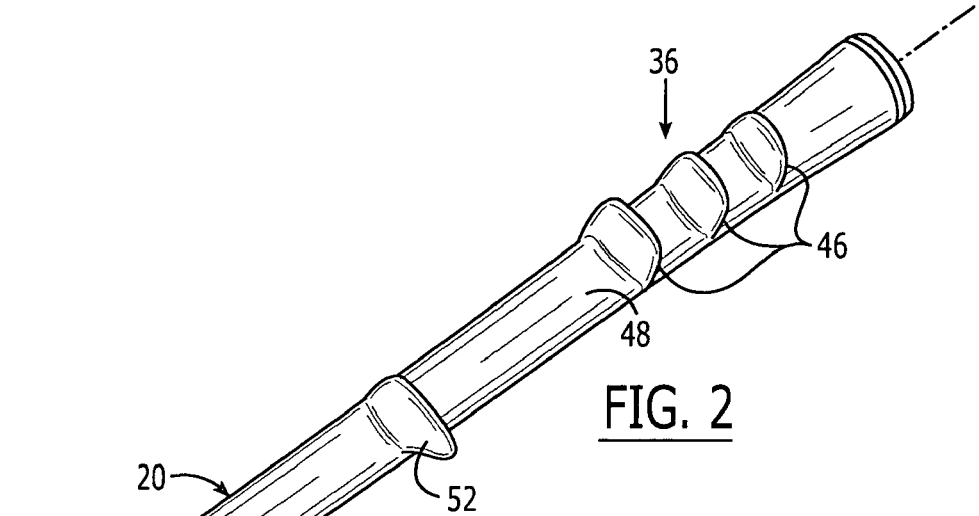
FIGS. 2 and 2A are bottom and side perspective views, respectively, of a grip useful with the device of FIG. 1.
Figure 2A:
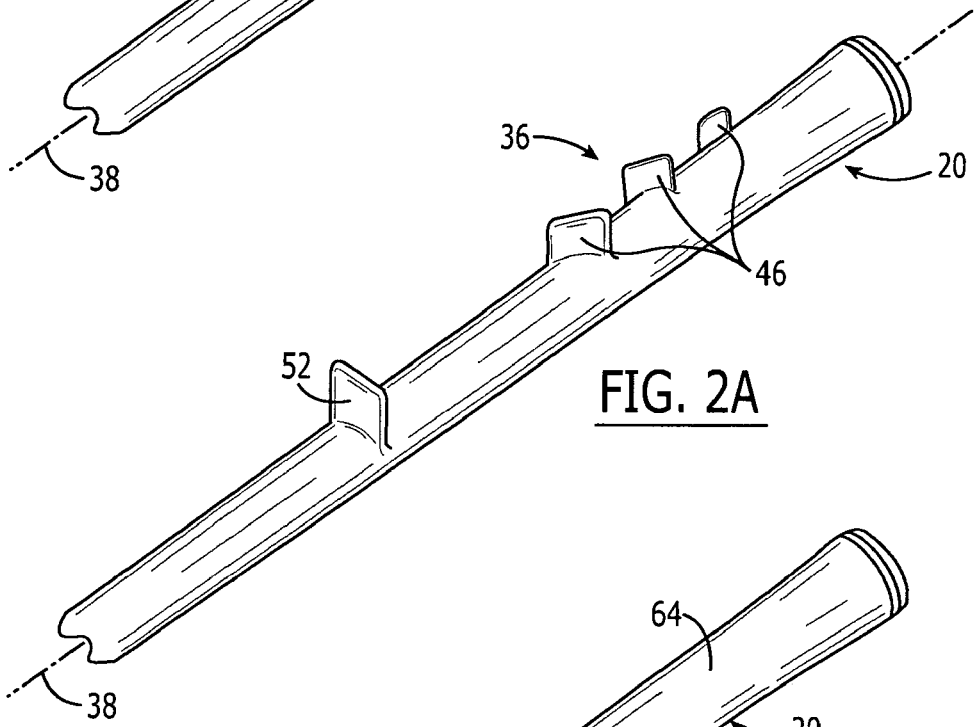
Figure 3:
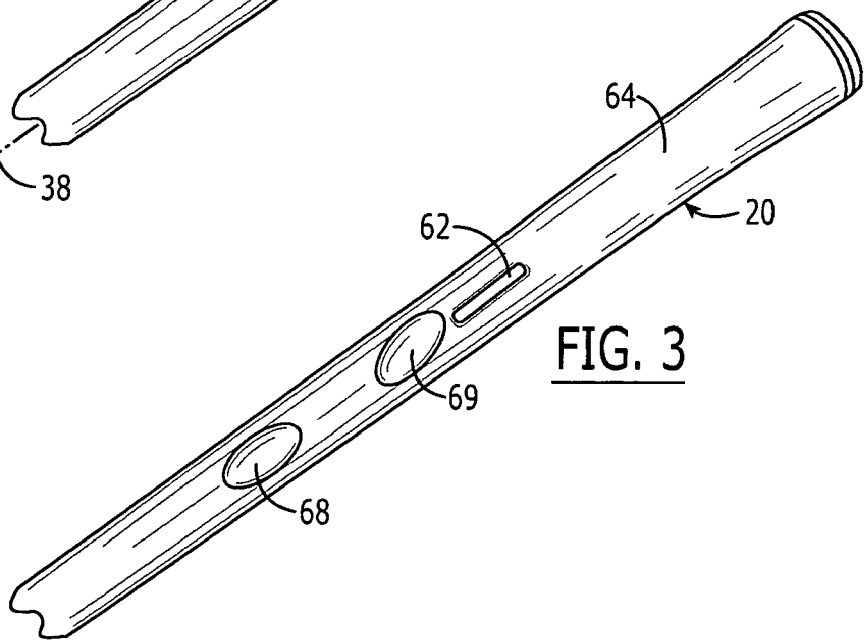
FIG. 3 is a top perspective view of the grip of FIG. 2.
Figure 4:
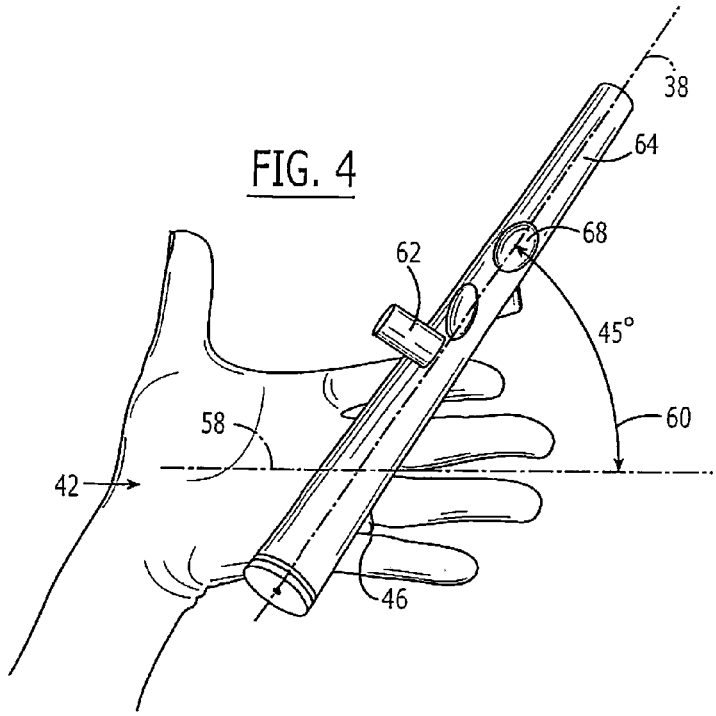
FIG. 4 is a partial side perspective view of the grip of FIG. 2 illustrating a placement of a top hand of a user carrying the grip within finger webs.
Figure 5:
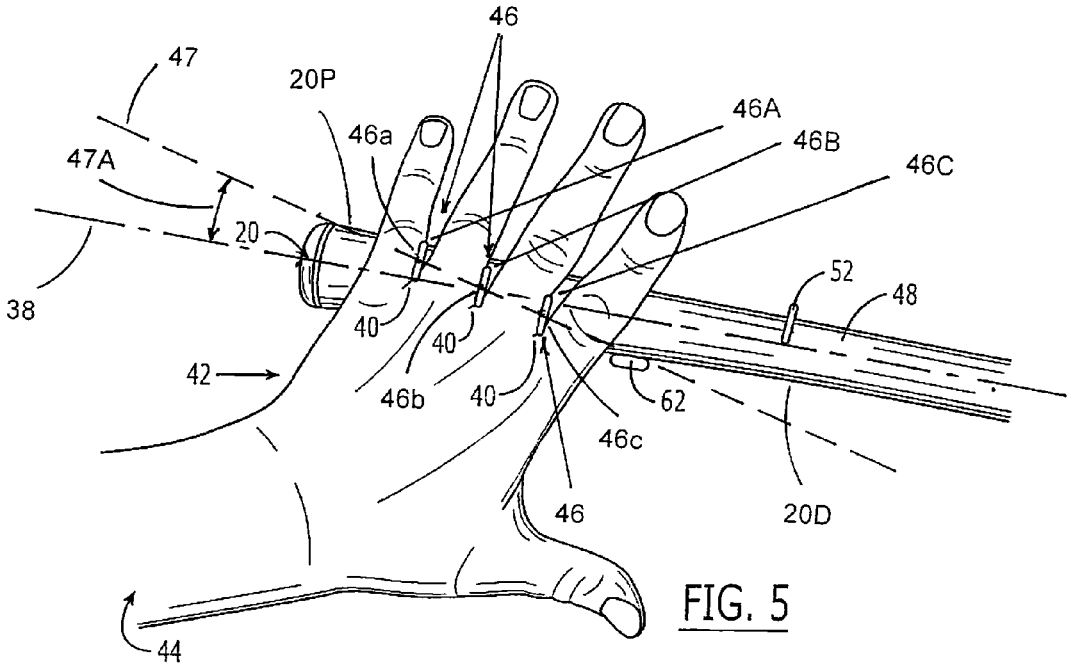
FIG. 5 is a plan view illustrating the placement of the top hand finger webs biased against protrusions on one embodiment of the grip, as illustrated in FIG. 4.
Figure 6:
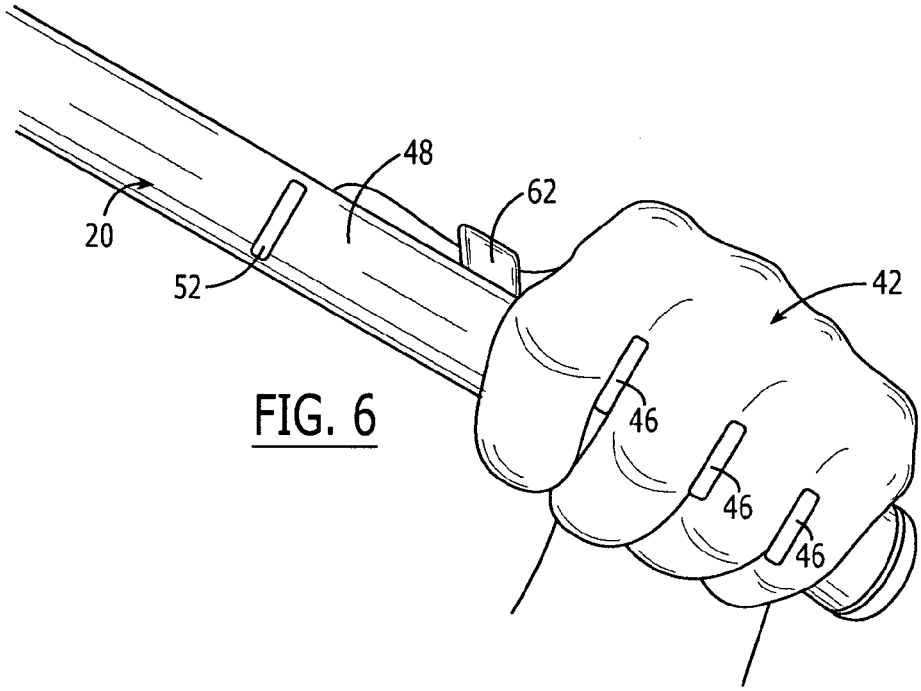
FIG. 6 is a perspective view of the top hand closed against the grip of FIG. 5.
Figure 8:
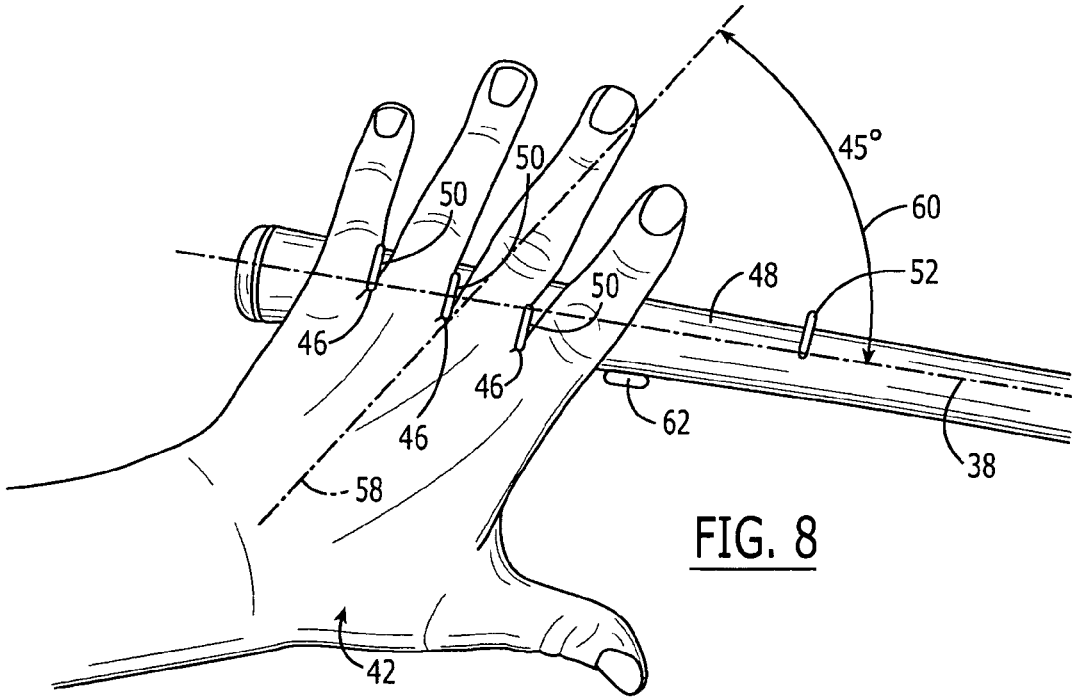
FIG. 8 is a plan view illustrating an angle between the grip of the top hand when webs of the fingers are biased against one embodiment of protrusions arranged on the grip.
Figure 7:
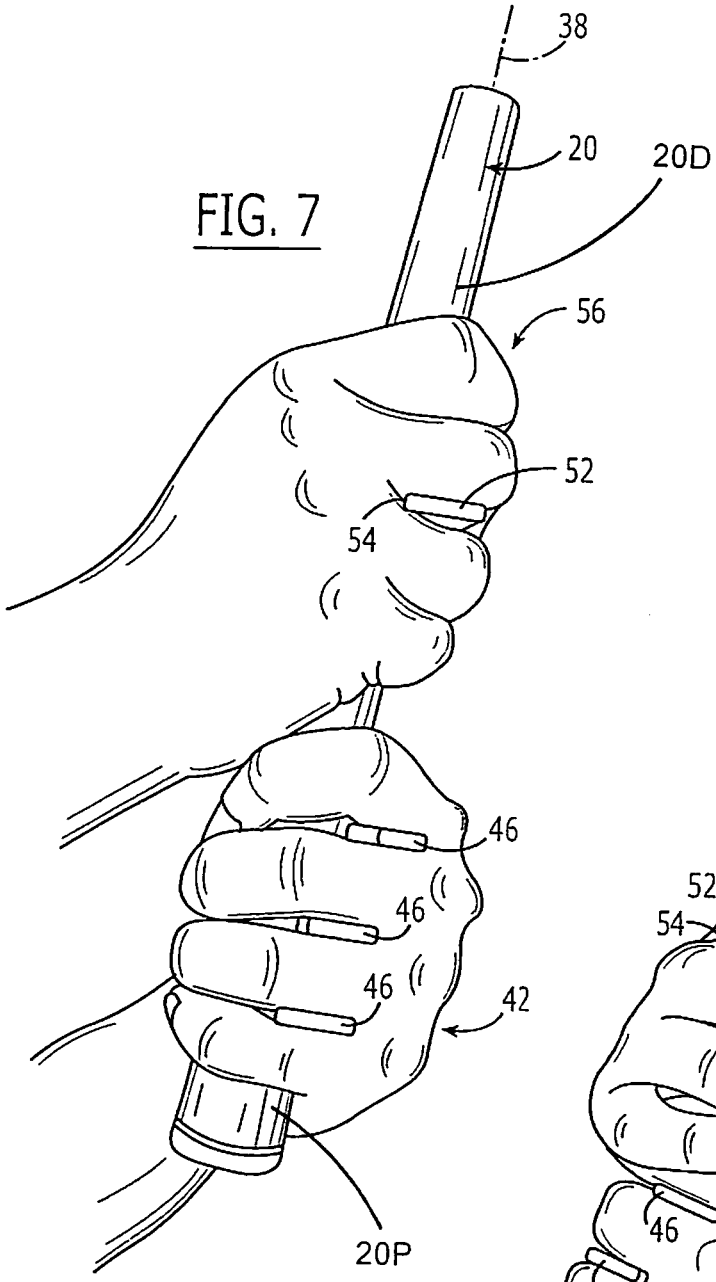
FIG. 7 is a perspective view of a baseball styled gripping of the grip of FIG. 5 illustrating top and bottom finger webs biased against protrusions carried by the grip.
Figure 7A:
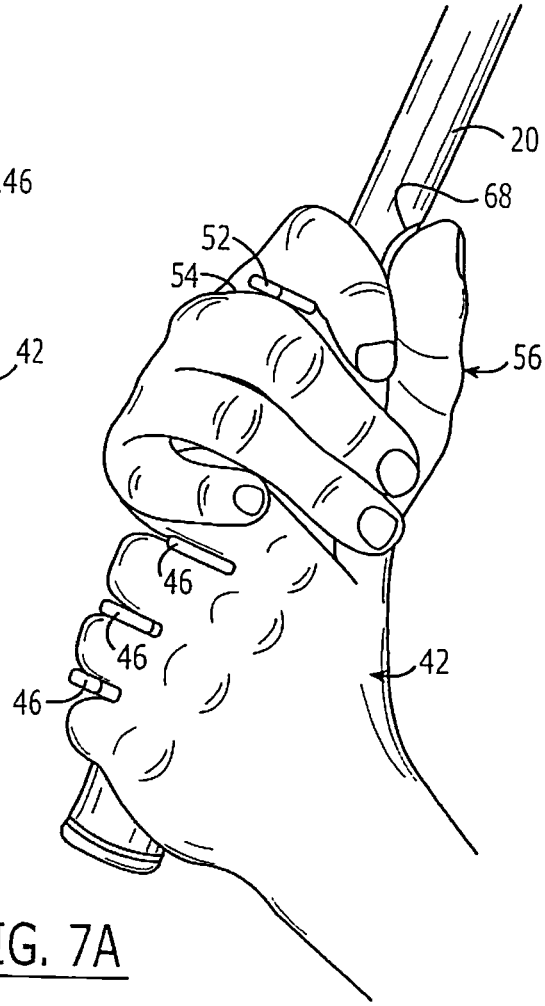
FIG. 7A is a perspective view of an overlapping styled gripping of the grip of FIG. 5 illustrating top and bottom finger webs biased against protrusions carried by the grip.

With reference to FIGS. 2, 2A, and 3, one embodiment of the grip 20, herein described by way of example, includes a plurality of protrusions 36 that extend outwardly from a longitudinal axis 38 of the grip and are arranged for receiving multiple finger webs 40 biased against them in guiding a hand 42 of the user 44, as illustrated with reference to FIGS. 4–6, for gripping the shaft 12 proximal end portion 14, earlier described with reference to FIG. 1. In one embodiment, the grip 20 may comprise three protrusions 46 for receiving the hand 42 that for a right-handed golfer will be the top hand on the shaft 12 positioned at a proximal portion 20P of the grip, as illustrated by way of example with reference to FIG. 7. The three protrusions 46 extend from a first side 48 of the grip 20 for receiving three webs 40 between four fingers of the top hand. With reference again to FIGS. 2, 2A, and 3, and to FIGS. 7 and 7A, another protrusion 52 for receiving a web 54 between fingers of the bottom hand 56 of the user 44 along a distal portion 20D of the grip 20. In one desired arrangement, and as illustrated with reference to FIG. 8, the longitudinal axis 38 of the grip 20 (coincident with the axis of the shaft 12) and an a centerline 58 through a palm of the top hand 42 form approximately a forty five degree angle 60. As further illustrated with reference again to FIG. 5, the protrusions 46 are aligned such that a line 47 extending through the protrusions along common points 46*a*, 46*b*, and 46*c* on each of the protrusions 46 forms a non-zero angle 47A with the longitudinal axis 38. Each protrusion 46A, 46B, 46C of the protrusions 46 is thus offset from an adjacent one protrusion along a circumference of the grip 20.

With reference again to FIGS. 2–4, a fourth protrusion 62 extends from a second side 64 radially offset from the first side 48 for receiving a thumb 66 of the top hand 42, as illustrated with reference again to FIG. 5, by way of example. Further, an indentation 68 is provided on the second side 64 for receiving a thumb of the bottom hand 56. A second indentation 69 is also provided on the grip second side 64 for use by the thumb of the top hand 52 while the thumb is biased against the protrusion 62.

With reference again to FIG. 1, the couplings 22, 24 and the sliding elements 30, 32 may have various embodiments within teachings of the present invention. By way of example, and with reference to FIGS. 9–11, the couplings 22, 24 and the sliding elements 30, 32 may be magnetically coupled with both being magnetized, one having a magnet and the other metallic, or the like. For the embodiment herein described by way of example, the sliding element comprises a plastic body 70 with a metallic ring 72 on a coupling side of the element. The sliding elements 30, 32 may be modified in weight by adding ballast material to the plastic body, by way of example, or by selecting a desired weighted element. The couplings 22, 24 are magnetized for the embodiment herein described. Alternatively, and as will come to those of skill in the art now having the benefit of the teachings of the present invention, friction or latching connections 25 may be used, such as an adhesive or Velcro, illustrated with reference again to FIG. 11. By way of example for the embodiment herein described for the gold training device 10, a first coupling force between the first coupling 22 and the first sliding element 30 is less than a second coupling force between the second coupling 24 and the second sliding element 32, thus less centrifugal force is required for releasing the first sliding element than for releasing the second sliding element.

Figure 9:
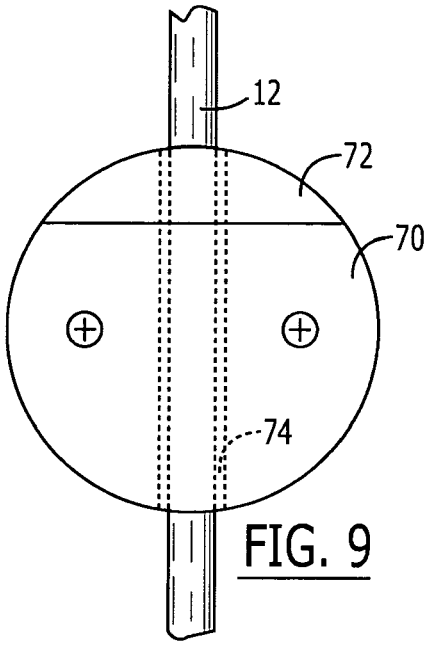
FIG. 9 is a partial plan view of one sliding element operable with a shaft.
Figure 11:
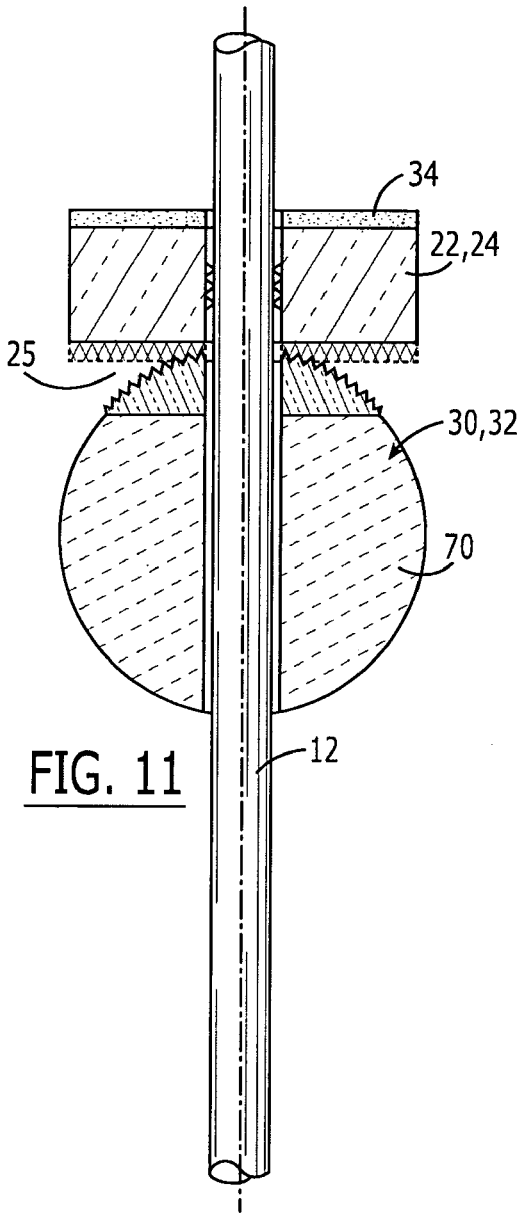
FIG. 11 is a partial cross section view illustrating a coupling and sliding element of FIG. 1.
Figure 10:
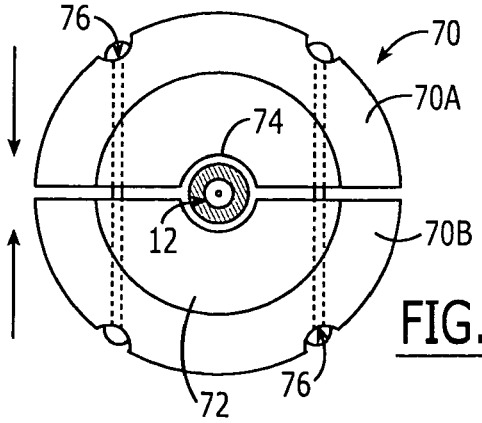
FIG. 10 is an end view of the embodiment of FIG. 9 illustrating a biasing of element portions against the shaft for selecting a friction contact therewith.

With continued reference to FIGS. 9–11, for the embodiment herein described, the first and second sliding elements 30, 32 comprise the body 70 having a bore 74 extending therethrough and dimensioned for sliding along the shaft 12. It may be desirable to modify the friction between the first and second sliding elements 30, 32 and the shaft 12. One embodiment for modifying the frictional force may include having each sliding element 30, 32 formed from two parts 70A, 70B and having the shaft 12 slidably received therebetween. By compressing the shaft 12 between the two parts 70A, 70B using connecting screws 76, a desired sliding friction between the sliding elements and the shaft is achieved. As a result and by way of example when simulating a golfing swing, the releasing of the sliding elements and the sliding along the shaft may be modified to accommodate a desired circumstance or user characteristic. The coupling forces between the first coupling and the first sliding element and between the second coupling and the second sliding element may be preset for a desired swinging movement.

Yet further with regard to training a swing, and with reference again to FIG. 1, an alignment element 78 may be carried by the shaft 12, which element may have a shape of a golf club head for the golf training device 10 herein described by way of example. In addition, a rod 80 may be carried within the shaft and longitudinally extendable from the proximal end portion 14 for viewing by the user during a swinging movement for identifying a swing plane therefor, desirable in one training exercise for a golf swing.

Figure 12:
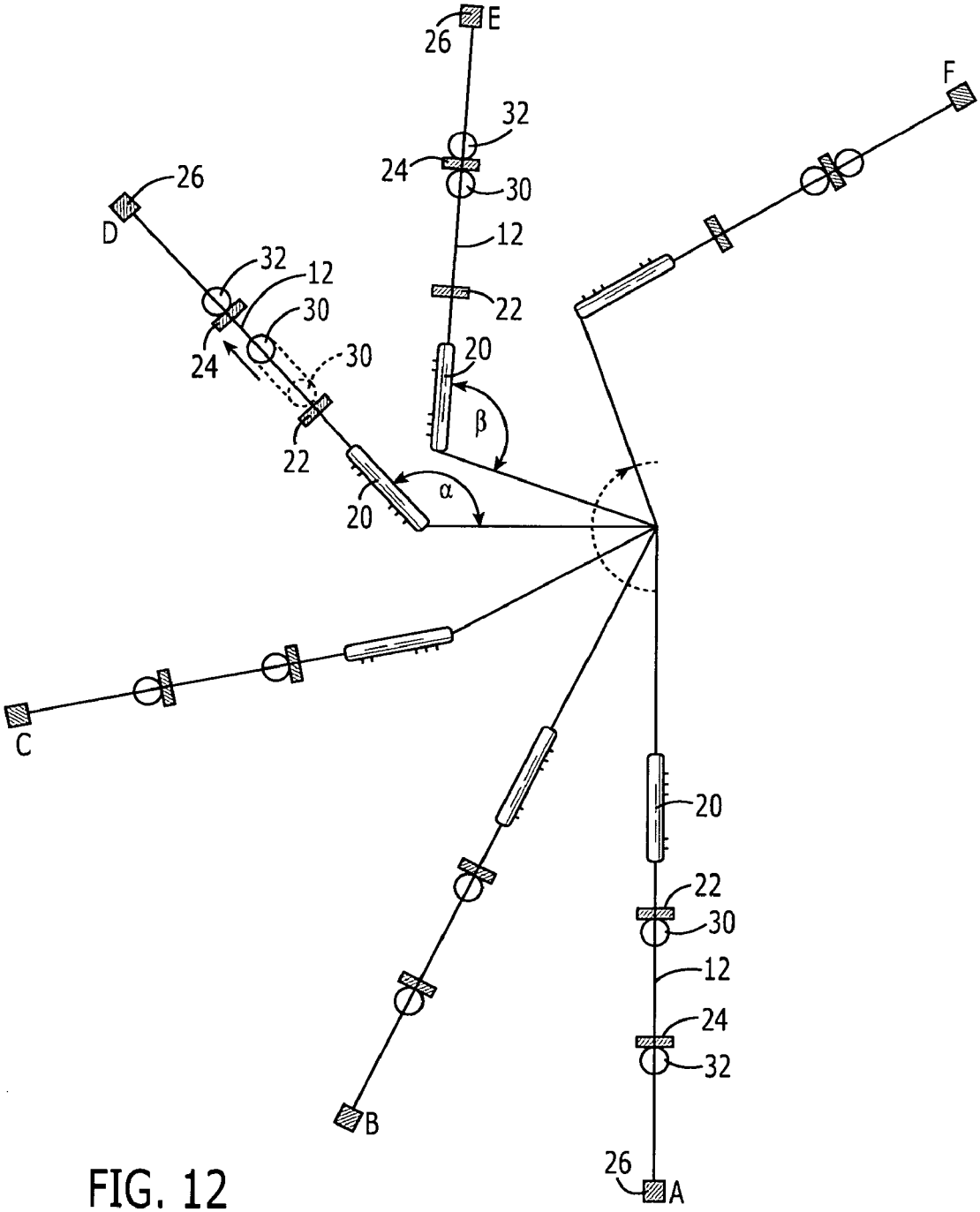
FIG. 12 is a diagrammatic view of a golfing backswing using the embodiment of FIG. 1.
Figure 13:
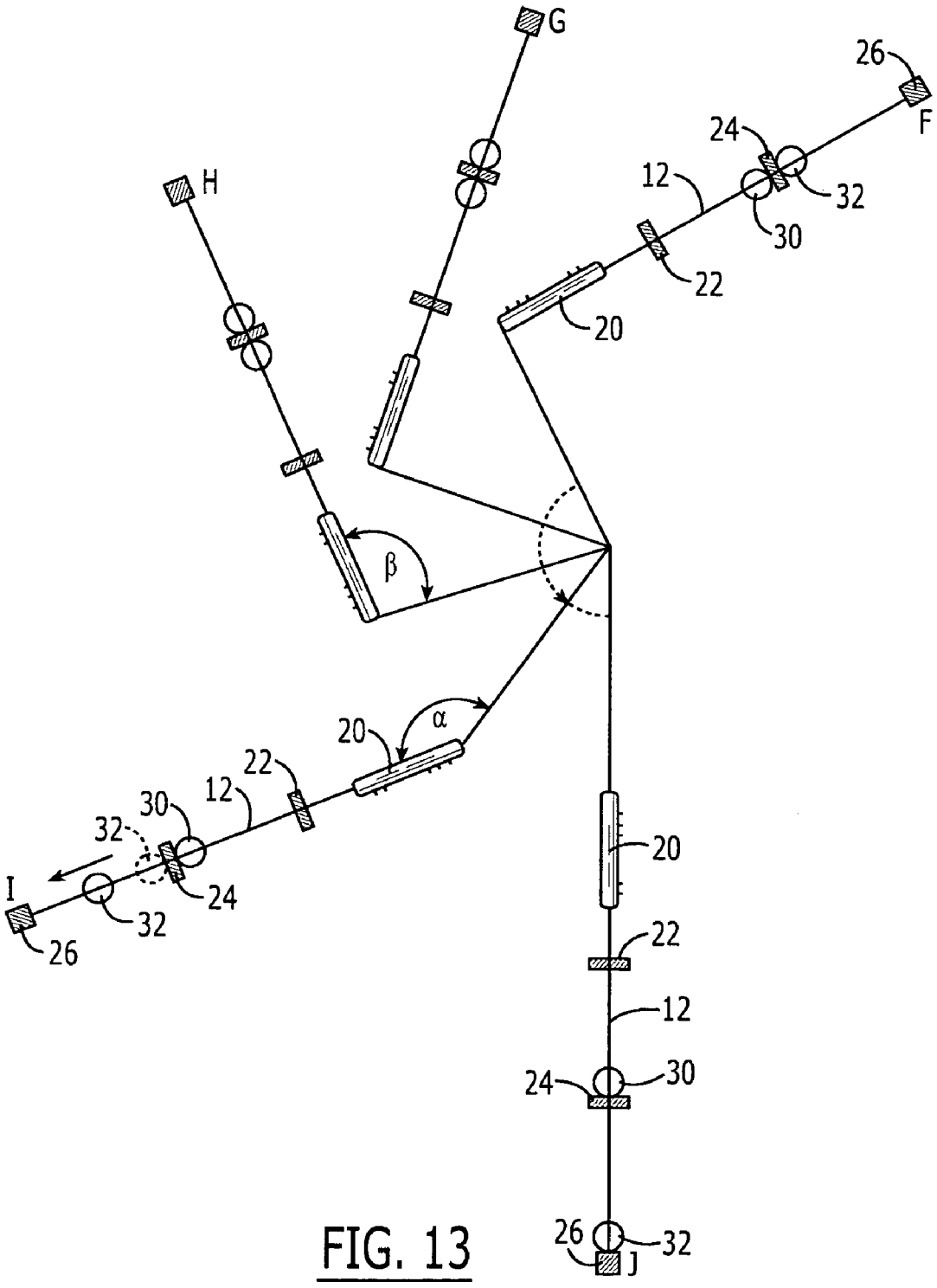
FIG. 13 is a diagrammatic view of a golfing downswing using the embodiment of FIG. 1.

By way of example, one method of use may include the training of a full golf swing. With reference now to FIGS. 12 and 13, during one desired swing, two impact or percussion sounds will be heard. With reference to FIG. 12 and to swing locations points A–F, the first sound is heard during the backswing at point E in the backswing as the first sliding element 30 contacts the second coupling 24. In order for the user to hear the noise associated with the backswing (the first sound), the user will need to "set" the club properly. For the example herein described, the first sliding element 30 will begin to leave the first coupling 22 near swing point D. This may require a cocking of the wrists and a slight increase in tempo during the backswing, illustrated by way of example with reference to angles $\alpha$ and $\beta$ for swing points D and E, respectively.

With reference again to FIG. 13, the second impact sound is desirably heard at point J. This is created when a desired tempo is used. By way of example, imagine a cracking of a whip. This allows the second sliding element 32 to be released from the second coupling 24, as illustrated at about point I, to slide down the shaft 12 and hit the stop 26. Typically, an un-cocking of the wrists as illustrated with angles $\beta$ to $\alpha$ in the downswing will cause a desired release of the second sliding element 32. The desired setting of the club going back and the desired releasing, or un-cocking, on the downswing provides a desirable maximum club head acceleration. As earlier described with reference to FIGS. 9–11, not every golfer swings with the same speed or force. With this in mind, the first and second slidable elements 30, 32 will be adjustable so that the beginner, as well as the seasoned professional will be allowed to train using the device 10. By way of example for one embodiment herein describe, the first sliding element 30 may require less centrifugal force to allow it to break free from its starting position. The second sliding element 32 may be set to require significantly more centrifugal force to be applied during the downswing to allow it to break free and contact the stop 26 at the end of the shaft 12.

Figure 14:
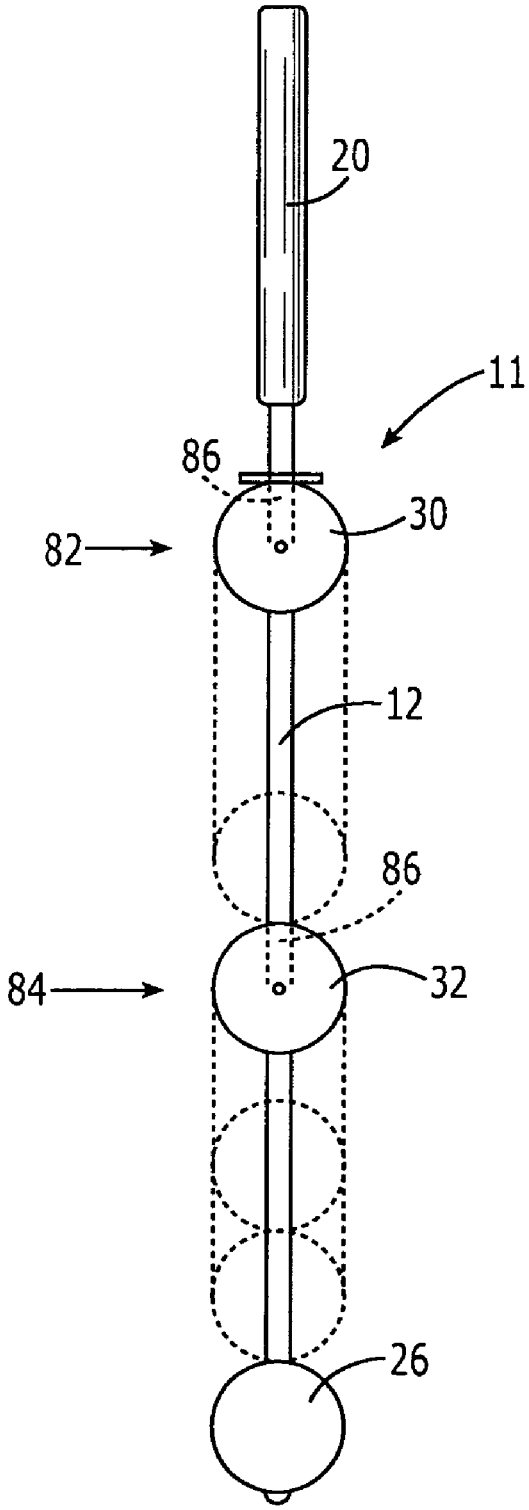
FIG. 14 is a plan view of an alternate embodiment of a swing training device.
Figure 16:
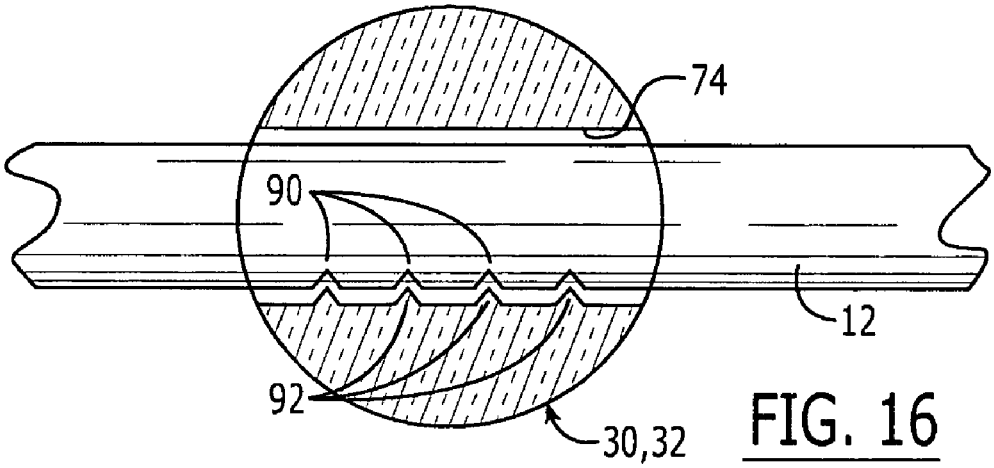
Figure 17:
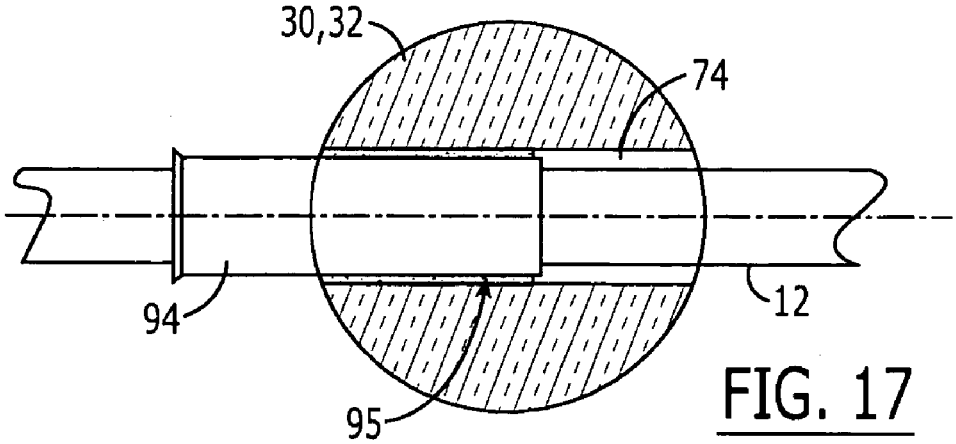

As illustrated with reference to FIG. 14, an alternate embodiment of the device 10, identified as device 11 may include a tapered golf shaft 12 and the two sliding elements 30, 32 to move freely after they have been released from their respective starting positions 82, 84. As above described with reference to FIG. 1, the stop 26 is carried at the shaft distal end 14 opposite the grip 20. The stop 26 prevents the first and second sliding elements 30, 32 from coming loose from the shaft 12 and provides a distinct sound at the time of the second impact portion of the swing creating the sound made during the downswing. The second sliding element 32 stops the first sliding element 30 when the user makes the desired backswing. The first sound is made when the first element 30 hits the second element 32 during the backswing. A release mechanism 86 (a friction barrier by way of example) described with reference to FIGS. 15–17 holds the first sliding element 30 in place during the completion of the backswing and releases both the first and second slidable elements for moving toward the stop 26 when sufficient force is applied during the downswing.

Figure 15:
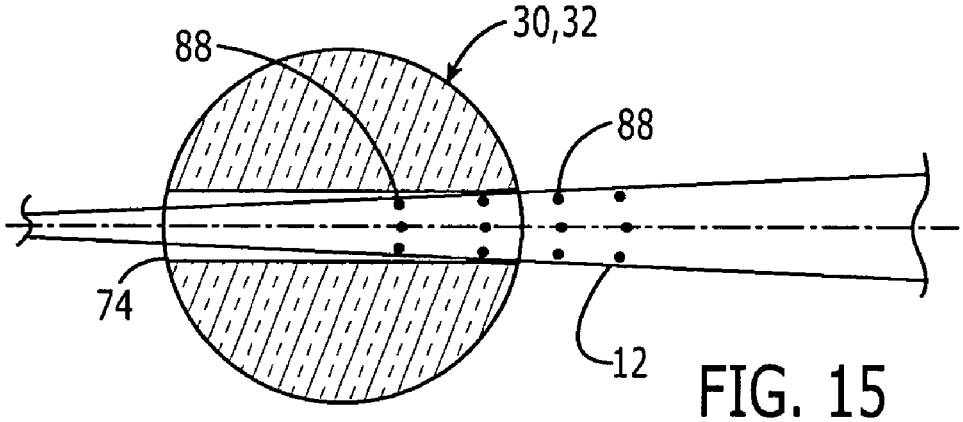
FIGS. 15, 16, and 17 are partial cross section views of a sliding element operable with a shaft for providing coupling and release mechanisms operable with embodiments of the present invention.

As illustrated by way of example with reference to FIG. 15, one embodiment may include the sliding element 30, 32 having the bore 74 forced into a taper of the tapered shaft 12 varying the frictional contact by pushing the element to a first, second, third indicator mark 88 made on the shaft. As illustrated with reference to FIG. 16, notches 90 and tabs 92 may be carried by the shaft 12, whether tapered or not, and by the surface of the bore 74, with a degree of releasing force countering a centrifugal force based on the number of notches engaged. Yet further, a friction sleeve 94 may be employed for establishing a preset frictional contact 95 between the element 30, 32 and the shaft 12, as illustrated by way of example with reference to FIG. 17.

Figure 18:
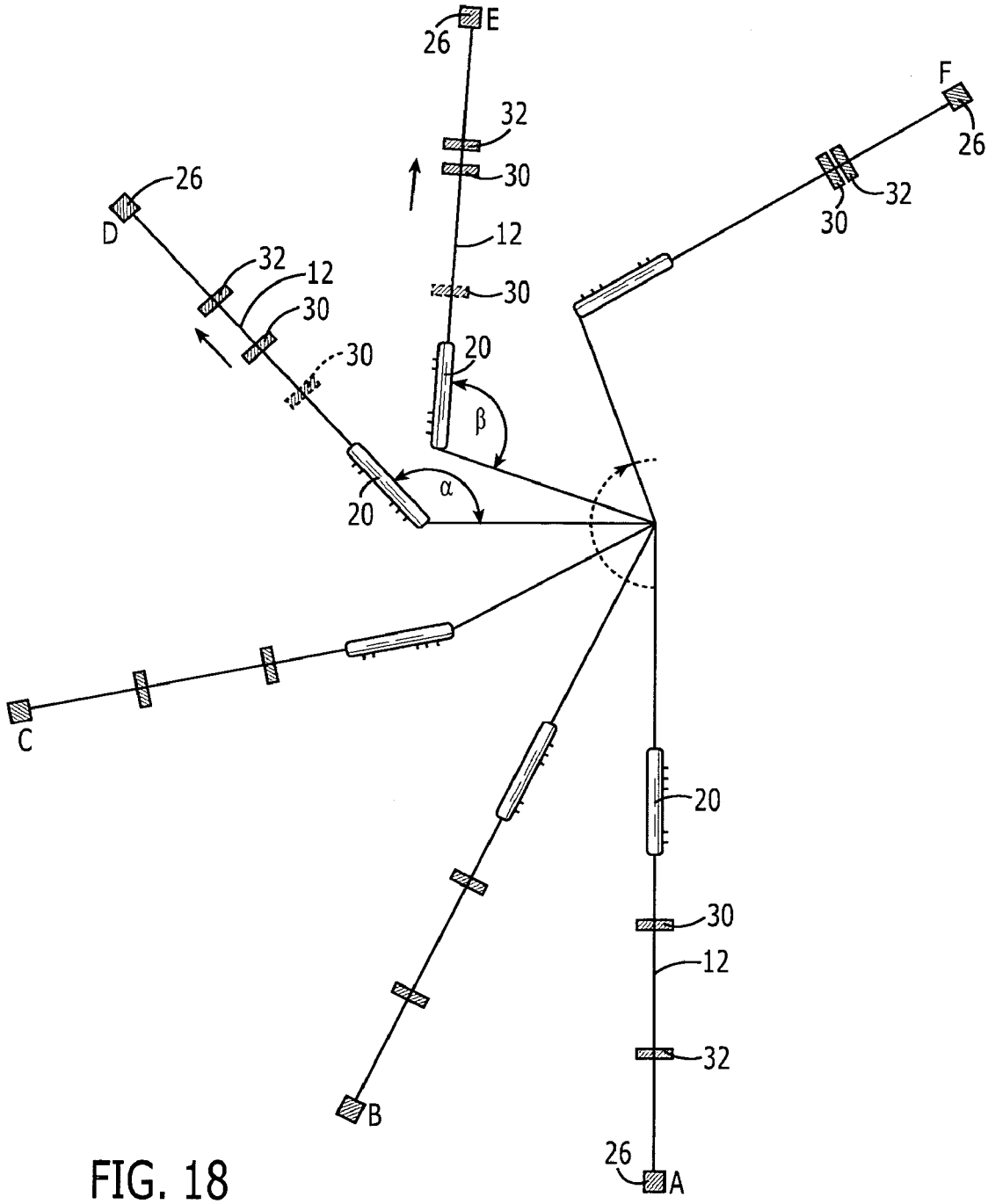
FIG. 18 is a diagrammatic view of a golfing backswing using the embodiment of FIG. 14.
Figure 19:
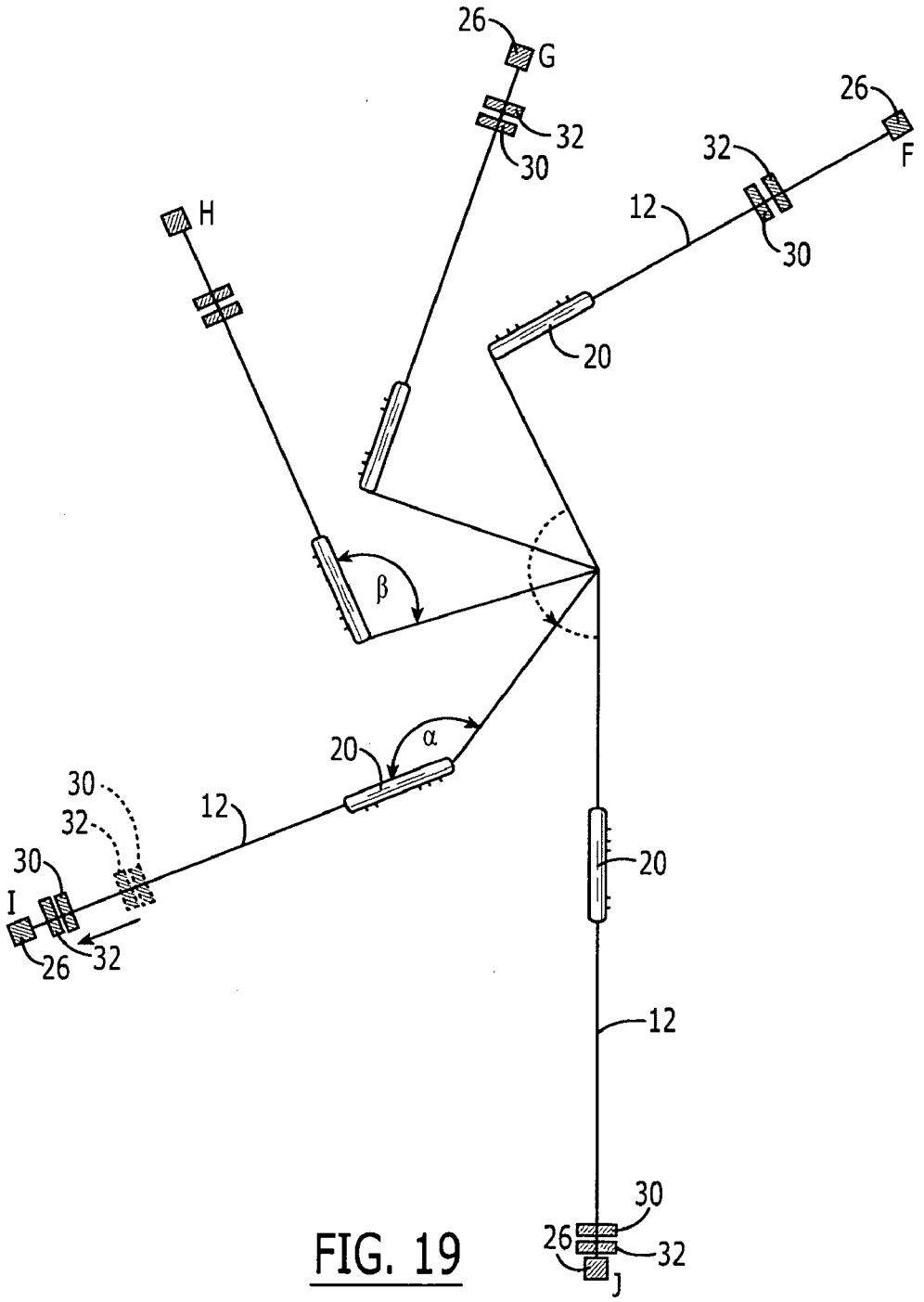
FIG. 19 is a diagrammatic view of a golfing downswing using the embodiment of FIG. 14.

As above described, during a desired swing, two impact or percussion sounds are heard. With reference to FIGS. 1 and 18, the first sound is heard during the backswing at point E. As above described, in order for the user to hear the noise associated with the backswing (the first sound), the user will need to "set" the club properly. This may require a cocking of the wrists and a slight increase in tempo during the backswing, by way of example. The second impact sound is heard at point J as illustrated with reference to FIG. 19. The sliding elements 30, 32 slide down the shaft 12 together and hit the stop 26. This will be when the wrists un-cock in the downswing. The desired setting of the club going back and the desired releasing, or un-cocking, on the downswing permits achieving maximum club head acceleration. As above described, not every golfer swings with the same speed or force. Therefore, frictional contact of the first and second sliding elements 30, 32 with the shaft 12 may be adjustable so that the beginner, as well as the seasoned professional will be allowed to practice with this device.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and alternate embodiments are intended to be included within the scope of the appended claims.

The invention claimed is:

1. A golf swing training device comprising:

an elongate shaft having a proximal end for holding by a user, an opposing distal end, and an intermediate portion therebetween;

a grip carried by the proximal end, the grip having a plurality of protrusions outwardly extending therefrom and arranged for receiving multiple finger webs thereagainst in guiding a hand of the user for gripping the shaft proximal end;

a first coupling fixedly attached to the shaft proximate the proximal end thereof;

a second coupling fixedly to the shaft within the intermediate portion thereof;

a stop fixedly attached to the shaft at the distal end thereof;

a first sliding element carried by the shaft for sliding movement along an outside surface of the shaft between the first and second couplings, wherein the first sliding element is coupled to the first coupling prior to a swinging of the shaft and released therefrom by a first centrifugal force exerted thereon during a first swinging motion of the shaft, and wherein the first sliding element accelerates to the second coupling for making contact therewith and creating a first sound thereby; and a second sliding element carried by the shaft for sliding movement along the outside surface of the shaft between the second coupling and the end stop, wherein the second sliding element is coupled to the second coupling prior to a swinging of the shaft and released therefrom by a second centrifugal force exerted thereon during a second swinging motion of the shaft, and wherein the second sliding element accelerates to the stop for making contact therewith and creating a second sound thereby.

2. A device according to claim 1, wherein the shaft comprises a circular cross section.

3. A device according to claim 2, wherein the shaft comprises a generally constant cross section from the proximal to distal ends.

4. A device according to claim 1, wherein the grip comprises:

a first plurality of protrusions for receiving a top hand of the user, wherein three protrusions extend from a first side of the grip for receiving three webs between four fingers of the top hand; and at least one protrusion for receiving at least one web between fingers of the bottom hand of the user.

5. A device according to claim 4, wherein a longitudinal axis of the shaft and an a centerline through a palm of the top hand form a forty five degree angle therebetween.

6. A device according to claim 4, wherein the first plurality of protrusions includes a fourth protrusion extending from a second side radially offset from the first side for receiving a thumb of the top hand.

7. A device according to claim 4, further comprising an indentation for receiving a thumb of the bottom hand.

8. A device according to claim 1, wherein at least one of the first and second couplings and the first and second sliding elements comprise at least one of a magnet and a metallic portion for removably attaching one to the other to be coupled.

9. A device according to claim 1, wherein at least one of the first and second couplings and the first and second sliding elements comprise at least one of a friction connection, a magnetic connection, and a latching connection for removably attaching one to the other to be coupled.

10. A device according to claim 1, wherein a first coupling force between the first coupling and the first sliding element is less than a second coupling force between the second coupling and the second sliding element, thus less centrifugal force is required for releasing the first sliding element than for releasing the second sliding element.

11. A device according to claim 1, wherein each of the first and second sliding elements comprise a body having a bore extending therethrough dimensioned for sliding along the shaft.

12. A device according to claim 11, further comprising friction means for modifying the friction between the first and second sliding elements and the shaft, thus modifying the sliding therealong.

13. A device according to claim 12, wherein the friction means comprises at least one of the first and second sliding elements being formed from two parts having the shaft slidably received therebetween, and wherein compressing the shaft between the two parts provides a desired sliding friction between the sliding element and the shaft.

14. A device according to claim 1, wherein the first swinging movement simulates a backswing movement of a golf club and the second swinging movement simulates a downswing movement of the golf club, and wherein coupling forces between the first coupling and the first sliding element and between the second coupling and the second sliding element are preset for swinging movements.

15. A device according to claim 1, further comprising an alignment element carried by the shaft proximate the grip.

16. A device according to claim 15, wherein the alignment element comprises a shape of a golf club head.

17. A device according to claim 1 further comprising a rod longitudinally extendable from the proximal end of the shaft for viewing by the user during a swinging movement for identifying a swing plane therefor.

18. A golf swing training device comprising:

an elongate shaft having a proximal end, an opposing distal end, and an intermediate portion therebetween;

a first coupling fixedly attached to the shaft proximate the proximal end thereof;

a second coupling fixedly to the shaft within the intermediate portion thereof;

a stop fixedly attached to the shaft at the distal end thereof;

a first sliding element carried by the shaft for sliding movement along an outside surface of the shaft between the first and second couplings, wherein the first sliding element is coupled to the first coupling prior to a swinging of the shaft and released therefrom by a first centrifugal force exerted thereon during a first swinging motion of the shaft, and wherein the first sliding element accelerates to the second coupling for making contact therewith and creating a first sound thereby; and a second sliding element carried by the shaft for sliding movement along the outside surface of the shaft between the second coupling and the end stop, wherein the second sliding element is coupled to the second coupling prior to a swinging of the shaft and released therefrom by a second centrifugal force exerted thereon during a second swinging motion of the shaft, and wherein the second sliding element accelerates to the stop for making contact therewith and creating a second sound thereby.

19. A device according to claim 18, wherein the shaft comprises a circular cross section.

20. A device according to claim 19, wherein the shaft comprises a generally constant cross section from the proximal to distal ends.

21. A device according to claim 18, wherein at least one of the first and second couplings and the first and second sliding elements comprise at least one of a friction connection, a magnetic connection, and a latching connection for removably attaching one to the other to be coupled.

22. A device according to claim 18, wherein a first coupling force between the first coupling and the first sliding element is less than a second coupling force between the second coupling and the second sliding element, thus less centrifugal force is required for releasing the first sliding element than for releasing the second sliding element.

23. A device according to claim 18, wherein each of the first and second sliding elements comprise a body having a bore extending therethrough dimensioned for sliding along the shaft.

24. A device according to claim 23, further comprising friction means for modifying the friction between the first and second sliding elements and the shaft, thus modifying the sliding therealong.

25. A device according to claim 24, wherein the friction means comprises at least one of the first and second sliding elements being formed from two parts having the shaft slidably received therebetween, and wherein compressing the shaft between the two parts provides a desired sliding friction between the sliding element and the shaft.

26. A device according to claim 18, wherein the first swinging movement simulates a backswing movement of a golf club and the second swinging movement simulates a downswing movement of the golf club, and wherein coupling forces between the first coupling and the first sliding element and between the second coupling and the second sliding element are preset for swinging movements.

27. A device according to claim 18, further comprising a grip carried at the proximal end of the shaft, the grip having a plurality of protrusions outwardly extending therefrom and arranged for receiving multiple finger webs thereagainst in guiding a hand of the user for gripping the shaft proximal end.

28. A device according to claim 27, wherein the grip further comprises:

a first plurality of protrusions for receiving a top hand of the user, wherein three protrusions extend from a first side of the grip for receiving three webs between four fingers of the top hand; and at least one protrusion for receiving at least one web between fingers of the bottom hand of the user.

29. A device according to claim 28, wherein the first plurality of protrusions includes a fourth protrusion extending from a second side radially offset from the first side for receiving a thumb of the top hand.

30. A golf swing training device comprising:

a shaft defined by a proximal end portion, a distal end portion, and an intermediate portion therebetween;

a first stop carried within the intermediate portion of the shaft;

a second stop fixedly attached to the distal end portion of the shaft;

a first element slidably carried along an outside surface of the shaft for movement from the proximal end portion of the shaft toward the first stop, wherein the first sliding element accelerates to the first stop for making contact therewith and creating a first sound thereby; and a second element slidably carried along the outside surface of the shaft for sliding movement from the intermediate portion toward the second stop, wherein the second element accelerates to the second stop for making contact therewith and creating a second sound thereby.

31. A device according to claim 30, wherein each of the first and second elements comprise a body having a bore extending therethrough dimensioned for sliding along the shaft.

32. A device according to claim 31, further comprising friction means for modifying friction between the first and second sliding elements and the shaft, thus modifying the sliding therealong.

33. A device according to claim 32, wherein the friction means comprises at least one of the first and second elements being formed from two parts having the shaft slidably received therebetween, and wherein compressing the shaft between the two parts provides a desired sliding friction between the sliding element and the shaft.

34. A device according to claim 30, further comprising a grip carried by the proximal end portion, the grip having a plurality of protrusions outwardly extending therefrom and arranged for receiving multiple finger webs thereagainst in guiding a hand of the user for gripping the shaft proximal end.

35. A device according to claim 30, further comprising a first coupling fixedly attached to the shaft within the proximal end portion thereof and a second coupling fixedly to the shaft within the intermediate portion thereof, wherein a first swinging movement simulates a backswing movement of a golf club and a second swinging movement simulates a downswing movement of the golf club, and wherein coupling forces between the first coupling and the first sliding element and between the second coupling and the second sliding element are separated therefrom by a preset swinging movement.

36. A device according to claim 30, wherein at least one of the first and second couplings and the first and second sliding elements comprise at least one of a magnet and a metallic portion for removably attaching one to the other to be coupled.

37. A device according to claim 30, wherein at least one of the first and second couplings and the first and second sliding elements comprise at least one of a friction connection, a magnetic connection, and a latching connection for removably attaching one to the other to be coupled.

38. A device according to claim 30, wherein a first coupling force between the first coupling and the first sliding element is less than a second coupling force between the second coupling and the second sliding element, thus less centrifugal force is required for releasing the first sliding element than for releasing the second sliding element.

39. A golf swing training device comprising a grip to be carried by a proximal end of a shaft, the grip having a plurality of protrusions outwardly extending therefrom and arranged for receiving multiple finger webs thereagainst in guiding a hand of a user for gripping the shaft proximal end, wherein three protrusions of the plurality of protrusions extend from a first side of the grip within a proximal portion therein for receiving three webs between four fingers of a top hand of the user gripping the proximal portion, and wherein an imaginary line extending through the three protrusions along common points thereof forms a non-zero angle with a longitudinal axis of the grip.

40. A device according to claim 39, wherein the grip further comprises:

at least one protrusion for receiving at least one web between fingers of a bottom hand of the user holding the grip along a distal portion thereof.

41. A device according to claim 40, wherein a longitudinal axis of the shaft and a centerline through a palm of the top hand form a forty five degree angle therebetween with the web of the top hand biased against the first plurality of protrusions.

42. A device according to claim 40, wherein the plurality of protrusions includes a fourth protrusion extending from a second side radially offset from the first side for receiving a thumb of the top hand.

43. A device according to claim 39, further comprising an indentation for receiving a thumb of the bottom hand.

44. A device according to claim 39, further comprising:

a shaft;

a first sliding element carried by the shaft for sliding movement between first and second positions, wherein the first sliding element slides along the shaft in response to a first centrifugal force exerted thereon during a first swinging motion of the shaft, and wherein the first sliding element accelerates to the second position for creating a first sound thereby; and a second sliding element carried by the shaft for sliding movement toward the shaft distal end in response to a second centrifugal force exerted thereon during a second swinging motion of the shaft, and wherein the second sliding element accelerates to shaft distal end for creating a second sound thereat.

45. A device according to claim 44, further comprising first and second couplings operative with the first and second sliding elements for removably fixing the first and second sliding elements at preset positions along the shaft.

46. A device according to claim 45, wherein at least one of the first and second couplings and the first and second sliding elements comprise at least one of a friction connection, a magnetic connection, and a latching connection for removably attaching one to the other to be coupled.

47. A device according to claim 45, wherein a first coupling force between the first coupling and the first sliding element is less than a second coupling force between the second coupling and the second sliding element, thus less centrifugal force is required for releasing the first sliding element than for releasing the second sliding element.

48. A device according to claim 45, wherein each of the first and second sliding elements comprise a body having a bore extending therethrough dimensioned for sliding along the shaft.

49. A device according to claim 48, further comprising friction means for modifying the friction between the first and second sliding elements and the shaft, thus modifying the sliding therealong.

50. A device according to claim 49, wherein the friction means comprises at least one of the first and second sliding elements being formed from two parts having the shaft slidably received therebetween, and wherein compressing the shaft between the two parts provides a desired sliding friction between the sliding element and the shaft.

51. A device according to claim 45, wherein a first swinging movement simulates a backswing movement of a golf club and a second swinging movement simulates a downswing movement of the golf club, and wherein coupling forces between the first coupling and the first sliding element and between the second coupling and the second sliding element are preset for swinging movements.

* * * * *